US009631313B2

(12) United States Patent
Kim et al.

(10) Patent No.: US 9,631,313 B2
(45) Date of Patent: Apr. 25, 2017

(54) WASHING MACHINE

(71) Applicant: SAMSUNG ELECTRONICS CO., LTD., Suwon-si, Gyeonggi-do (KR)

(72) Inventors: Dong Young Kim, Seoul (KR); Doo Young Ryu, Suwon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 48 days.

(21) Appl. No.: 13/911,704

(22) Filed: Jun. 6, 2013

(65) Prior Publication Data

US 2013/0269398 A1 Oct. 17, 2013

Related U.S. Application Data

(63) Continuation of application No. 13/317,298, filed on Oct. 14, 2011, now Pat. No. 9,416,481.

(30) Foreign Application Priority Data

Oct. 26, 2010 (KR) ..... 10-2010-0104392

(51) Int. Cl.
*D06F 39/02* (2006.01)
*D06F 39/08* (2006.01)

(52) U.S. Cl.
CPC ..... *D06F 39/02* (2013.01); *D06F 39/028* (2013.01); *D06F 39/088* (2013.01); *Y10T 29/49826* (2015.01)

(58) Field of Classification Search
CPC ..... D06F 39/02; D06F 39/088; D06F 39/028; Y10T 29/49826
USPC ..... 68/3 R, 5 C, 17 R, 212, 207
See application file for complete search history.

(56) References Cited

U.S. PATENT DOCUMENTS 3,448,596 A * 6/1969 Bochan ..... 68/18 F
5,350,202 A 9/1994 Fritz et al.
5,875,574 A 3/1999 De Rugeriis
5,931,510 A * 8/1999 Mathew et al. ..... 285/148.21
6,467,508 B1 * 10/2002 Emad et al. ..... 138/137
7,293,436 B2 * 11/2007 No et al. ..... 68/17 R
7,398,661 B2 7/2008 Rizzetto
(Continued)

FOREIGN PATENT DOCUMENTS

EP 0913514 A2 5/1999
EP 1595991 A1 11/2005
(Continued)

OTHER PUBLICATIONS

LG Steam Washer Users Guide and Installation Instructions, Mar. 31, 2009.*
(Continued)

*Primary Examiner* — Alexander Markoff
(74) *Attorney, Agent, or Firm* — Staas & Halsey LLP

(57) ABSTRACT

A washing machine includes a cabinet, a washing tub disposed in the cabinet, a detergent supply device to supply detergent to the washing tub, a valve housing, having valve devices to control water supply, connected to the detergent supply device, a coupling pipe coupled to a water supply hose outside the cabinet to guide water into the cabinet, and a connection pipe to connect the valve housing to the coupling pipe, wherein the valve housing is directly coupled to the detergent supply device, and the connection pipe is fixed to the valve housing and the coupling pipe.

16 Claims, 8 Drawing Sheets

(56) References Cited

U.S. PATENT DOCUMENTS

| | | | | |
|---|---|---|---|---|
| 2004/0103696 | A1* | 6/2004 | Kim et al. | 68/17 R |
| 2005/0252251 | A1* | 11/2005 | Rizzetto | 68/17 R |
| 2005/0262881 | A1* | 12/2005 | Rizzetto | 68/3 R |
| 2008/0196267 | A1* | 8/2008 | Park et al. | 34/443 |
| 2008/0282750 | A1* | 11/2008 | Yang et al. | 68/5 C |
| 2009/0256353 | A1* | 10/2009 | Thrift et al. | 285/256 |
| 2010/0102082 | A1 | 4/2010 | Ebrom | |
| 2011/0133447 | A1* | 6/2011 | Robin et al. | 285/309 |

FOREIGN PATENT DOCUMENTS

| | | | |
|---|---|---|---|
| EP | 1600546 | A1 | 11/2005 |
| EP | 2360309 | A1 | 8/2011 |
| JP | 2000-170663 | | 6/2000 |
| KR | 1999-0048028 | | 7/1999 |
| KR | 10-2005-0118894 | | 12/2005 |
| KR | 10-2007-0088212 | | 8/2007 |

OTHER PUBLICATIONS

LG website with release information of the manual of the Steam Washer, no date available.*

European Search Report dated Jan. 23, 2012 issued in corresponding European Patent Application No. 11185694.4.

U.S. Appl. No. 13/317,298, filed Oct. 14, 2011, Dong Young Kim, Samsung Electronics Co., Ltd.

U.S. Office Action dated Feb. 24, 2015 in U.S. Appl. No. 13/317,298.

U.S. Office Action dated Jun. 24, 2015 in U.S. Appl. No. 13/317,298.

U.S. Office Action dated Nov. 17, 2015 from U.S. Appl. No. 13/317,298.

U.S. Notice of Allowance dated Apr. 18, 2016 from U.S. Appl. No. 13/317,298.

Korean Office Action dated Jan. 5, 2017, from Korean Patent Application No. 10-2010-0104392, 16 pages.

* cited by examiner

WASHING MACHINE

CROSS-REFERENCE TO RELATED APPLICATIONS

This application is a continuation of U.S. application Ser. No. 13/317,298, filed on Oct. 14, 2011, which claims the benefit of Korean Patent Application No. 10-2010-0104392, filed on Oct. 26, 2010 in the Korean Intellectual Property Office, the disclosure of which is incorporated herein by reference.

BACKGROUND

1. Field

Embodiments of the present disclosure relate to a washing machine having a water supply unit assembly with improved wear resistance at a connection region between a water supply hose and the water supply unit assembly.

2. Description of the Related Art

Generally, a washing machine, including a rotary tub to contain laundry, such as clothes, and a motor to drive the rotary tub, performs a series of washing cycles, such as washing, rinsing and spin-drying, using rotary motion of the rotary tub.

The washing machine is connected to an external water supply hose so that water is supplied to the washing machine. The water introduced into the washing machine passes through a detergent supply device containing detergent, where the water is mixed with the detergent and supplied into a washing tub.

A valve device is provided to control water supply based on the washing cycles, such as preliminary washing, main washing and rinsing. The valve device is disposed ahead of the detergent supply device. The valve device is connected to the detergent supply device via a flexible hose.

When the hose is connected to the valve device and the detergent supply device, clamps are coupled to connection regions therebetween to prevent water leakage. For this reason, the number of assembly processes is increased, and cost of parts is increased.

An integral water supply unit assembly, assembled by directly coupling the valve device to the detergent supply device and connecting a rigid connection pipe to the valve device, is used. Since the integral water supply unit assembly is generally rigid, however, it may be difficult to assemble the water supply unit assembly to a cabinet due to interference of a front plate in a state in which the front plate is assembled to the cabinet. For this reason, the washing machine assembly processes may be partially changed.

SUMMARY

It is an aspect of the present disclosure to provide a washing machine having a water supply unit assembly exhibiting improved wear resistance wherein the assemblability of the washing machine is improved.

Additional aspects of the disclosure will be set forth in part in the description which follows and, in part, will be apparent from the description, or may be learned by practice of the disclosure.

In accordance with one aspect of the present disclosure, a washing machine includes a cabinet, a washing tub disposed in the cabinet, a detergent supply device to supply detergent to the washing tub, a valve housing, having valve devices to control water supply, connected to the detergent supply device, a coupling pipe coupled to a water supply hose outside the cabinet to guide water into the cabinet, and a connection pipe to connect the valve housing to the coupling pipe, wherein the valve housing is directly coupled to the detergent supply device, and the connection pipe is fixed to the valve housing and the coupling pipe.

The valve housing and the coupling pipe may be made of different materials.

The coupling pipe may be made of a material exhibiting higher wear resistance than the valve housing.

The coupling pipe may be made of polyamide (PA).

The valve housing may include a plurality of valve mounting parts, at which the respective valve devices are mounted, and a plurality of discharge pipes connected to the respective valve mounting parts, and at least one of the discharge pipes may be coupled to the detergent supply device.

The washing machine may further include a steam generator to supply steam to the washing tub, wherein one of the discharge pipes may be coupled to the steam generator.

The valve housing may be fixed to the detergent supply device by a screw.

The connection pipe may be rigid.

The connection pipe may include a first connection pipe and a second connection pipe spaced a predetermined distance from each other and a fixing member to fix the first connection pipe and the second connection pipe.

The connection pipe may have an outer diameter corresponding to an inner diameter of the coupling pipe, and the connection pipe may be fitted in the coupling pipe.

The valve housing and the connection pipe may be integrally formed.

The coupling pipe and the connection pipe may be integrally formed.

In accordance with another aspect of the present disclosure, a washing machine includes a cabinet forming an external appearance thereof, a washing tub disposed in the cabinet, a detergent supply device to supply water and detergent to the washing tub, a valve housing, having a valve device to control water supply, connected to the detergent supply device, a bracket coupled to a water supply hose outside the cabinet and connected to the valve housing to guide water to the valve housing, and an assembly port formed at the rear of the cabinet, wherein the valve housing is directly coupled to the detergent supply device, and the bracket passes through the assembly port from the inside to the outside of the cabinet in a state in which the bracket is connected to the detergent supply device and the valve housing.

The bracket may include a coupling pipe coupled to the water supply hose to guide water into the cabinet and a support plate formed around the coupling pipe.

The bracket may further include a socket coupling part protruding from the support plate.

The washing machine may further include a fixing socket coupled to the assembly port and the bracket to fix the bracket to the cabinet.

The fixing socket may include a socket body and a flange formed by bending one end of the socket body, the socket body may be fitted in the assembly port so as to be coupled to the bracket, and the flange may be fixed to the outside of the cabinet.

In accordance with another aspect of the present disclosure, a washing machine includes a cabinet forming an external appearance thereof, a washing tub disposed in the cabinet, a detergent supply device to supply detergent to the washing tub, a valve housing, having a valve to control water supply, connected to the detergent supply device, a bracket including a coupling pipe coupled to a water supply hose outside the cabinet to guide water into the cabinet, and an assembly port formed at the rear of the cabinet, wherein the valve housing is fixedly coupled to the detergent supply device and the coupling pipe, the coupling pipe is made of a material exhibiting higher wear resistance than the valve housing, and the bracket passes through the assembly port from the inside to the outside of the cabinet in a state in which the bracket is connected to the detergent supply device and the valve housing.

In accordance with a further aspect of the present disclosure, a method of assembling a washing machine includes preparing a cabinet open at the top and the front thereof, the cabinet having an assembly port formed at the rear thereof, assembling a detergent supply device, a valve housing to be connected to the detergent supply device and a bracket to be connected to the valve housing and coupled to a water supply hose outside the cabinet to guide water into the valve housing to prepare a rigid water supply unit assembly, assembling a front plate to the cabinet so as to form an edge at which the top and the front of the cabinet join each other, shifting the bracket through the assembly port from the inside to the outside of the cabinet so that the water supply unit assembly is placed in the cabinet, and adjusting the position of the water supply unit assembly in the cabinet so that the water supply unit assembly is fixedly mounted in the cabinet.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
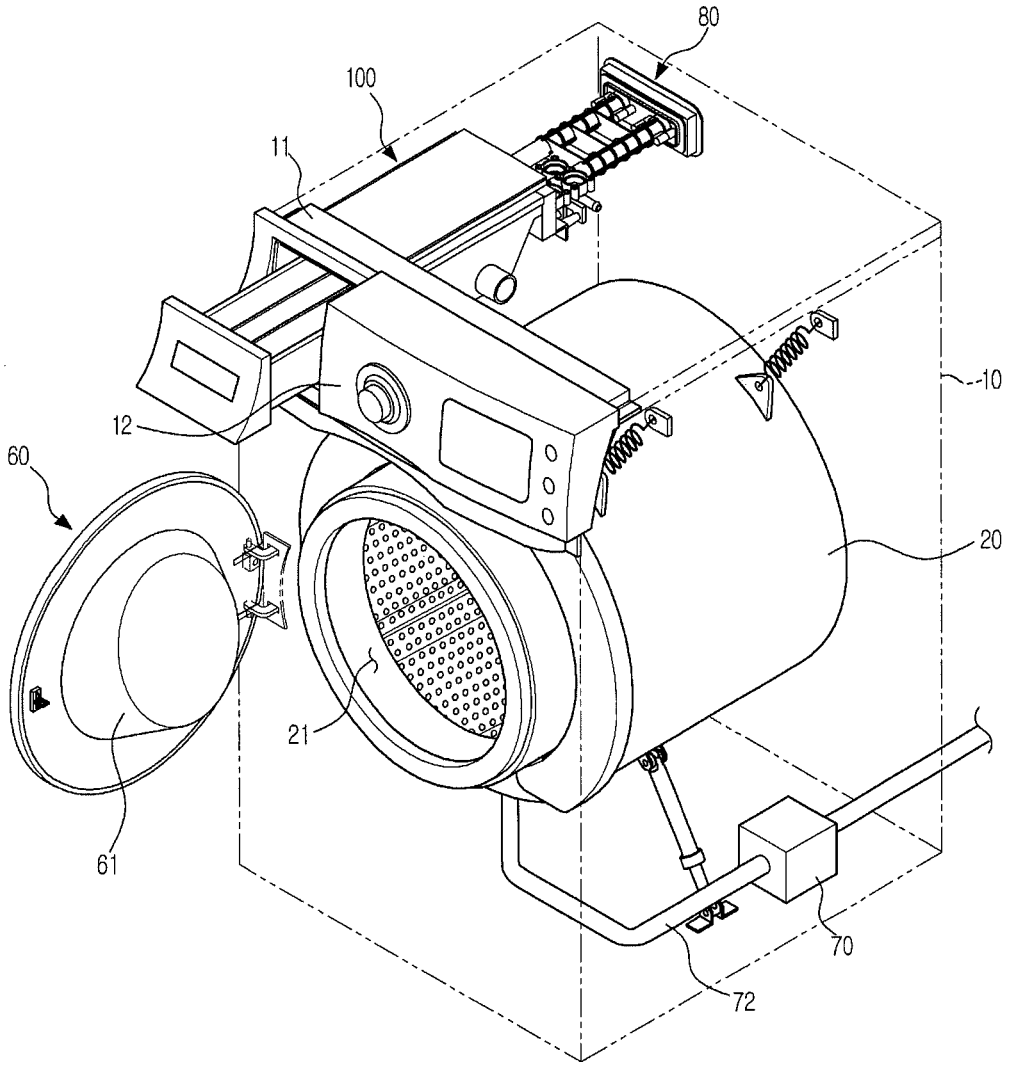
FIG. 1 is a perspective view showing principal components of a washing machine according to an embodiment of the present disclosure.

Reference will now be made in detail to the embodiments of the present disclosure, examples of which are illustrated in the accompanying drawings, wherein like reference numerals refer to like elements throughout.

Figure 2:
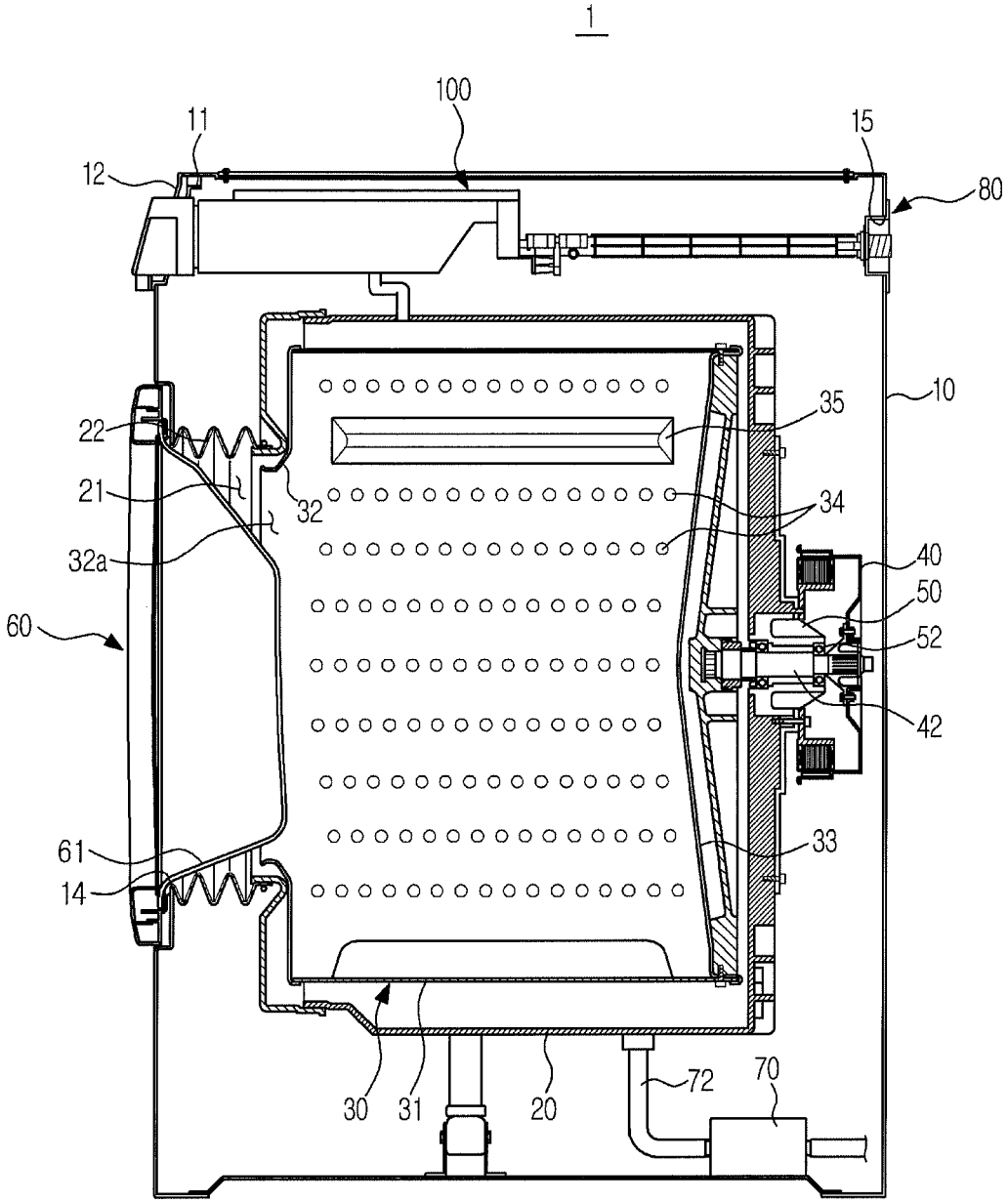
FIG. 2 is a plan view showing the principal components of the washing machine according to the embodiment of the present disclosure.

FIG. 1 is a perspective view showing principal components of a washing machine according to an embodiment of the present disclosure, and FIG. 2 is a plan view showing the principal components of the washing machine according to the embodiment of the present disclosure.

As shown in FIGS. 1 and 2, the washing machine 1 includes a cabinet 10 forming the external appearance thereof, a washing tub 20 disposed in the cabinet 10, a rotary tub 30 rotatably disposed in the washing tub 20, and a motor 40 to drive the rotary tub 30.

A front plate 11, forming the edge of the front and top of the cabinet 10, is coupled to the upper side of the front of the cabinet 10. A control panel mounting unit 12 is coupled to the front plate 11.

The cabinet 10 is provided at the front thereof with an introduction port 14, through which laundry is introduced into the rotary tub 30. The introduction port 14 is opened and closed by a door 60 mounted at the front of the cabinet 10. A door glass 61 to allow a user to see the interior of the rotary tub 30 is mounted inside the door 60.

The washing tub 20 is provided at the front thereof with an opening 21 formed at a position corresponding to the introduction port 14. A gasket 22 is connected between the introduction port 14 and the opening 21 to seal a space defined between the introduction port 14 of the cabinet 10 and the opening 21 of the washing tub 20. The gasket 22 is fixed to the cabinet 10 and the washing tub 20. The gasket 22 may be formed of an elastic material to absorb vibration from the washing tub 20.

A drainage pump 70 and a drainage pipe 72 to discharge water from the washing tub 20 to the outside of the cabinet 10 are mounted below the washing tub 20.

The rotary tub 30 includes a cylindrical part 31, a front plate 32 disposed at the front of the cylindrical part 31, and a rear plate 33 disposed at the rear of the cylindrical part 31. The front plate 32 has an opening 32*a* through which washing water is introduced and discharged. A drive shaft 42 to transmit power from the motor 40 is connected to the rear plate 33.

A bearing housing 50 to rotatably support the drive shaft 42 is mounted at the rear wall of the washing tub 20. The bearing housing 50 may be made of an aluminum alloy. The bearing housing 50 may be inserted into the rear wall of the washing tub 20 during injection molding of the washing tub 20. Bearings 52 are mounted between the bearing housing 50 and the drive shaft 42 so that the drive shaft 42 smoothly rotates.

The drive shaft 42 is disposed between the rotary tub 30 and the motor 40. One end of the drive shaft 42 is connected to the rear plate 33 of the rotary tub 30, and the other end of the drive shaft 42 extends out of the rear wall of the washing tub 20. When the drive shaft 42 is driven by the motor 40, the rotary tub 30 connected to the drive shaft 42 rotates about the drive shaft 42.

A plurality of through holes 34, through which washing water flows, is formed at the circumference of the rotary tub 30. A plurality of lifters 35 to lift and drop laundry during rotation of the rotary tub 30 is mounted inside the rotary tub 30.

During washing and rinsing cycles, the motor 40 rotates the rotary tub 30 in alternating directions at low speed. During rotation of the rotary tub 30, laundry in the rotary tub 30 is repeatedly lifted and dropped so that contaminants are removed from the laundry.

During a spin-drying cycle, the motor 40 rotates the rotary tub 30 in one direction at high speed so that water is separated from the laundry by centrifugal force acting on the laundry.

A water supply unit assembly 100 to supply water and detergent to the washing tub 20 is mounted above the washing tub 20. An assembly port 15 and a fixing socket 80 to fixedly assemble the water supply unit assembly 100 to the cabinet 10 are provided at the rear of the cabinet 10.

Figure 3:
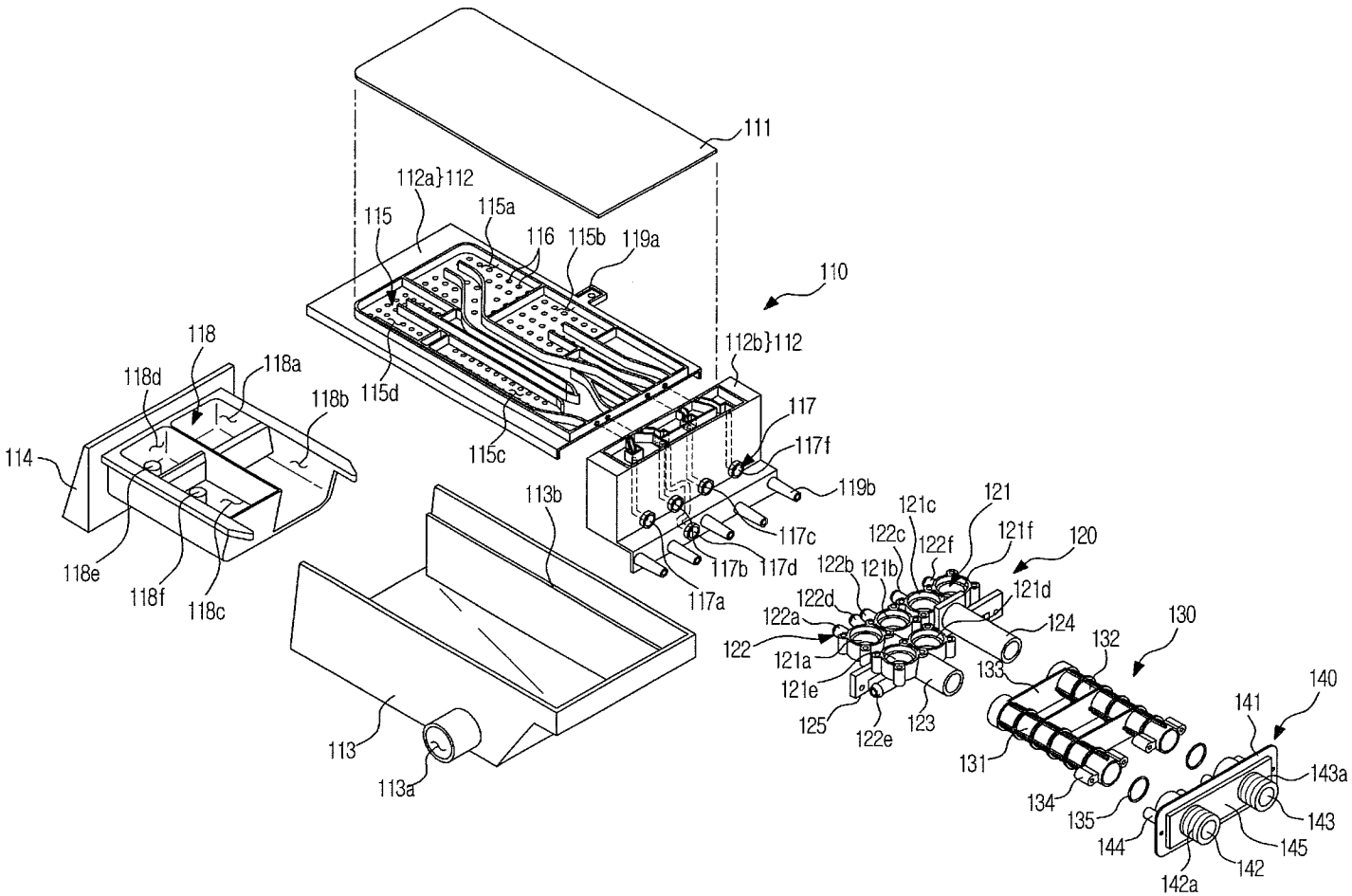
FIG. 3 is an exploded perspective view showing a water supply unit assembly according to an embodiment of the present disclosure.

FIG. 3 is an exploded perspective view showing a water supply unit assembly according to an embodiment of the present disclosure.

As shown in FIG. 3, the water supply unit assembly 100 includes a detergent supply device 110, a valve housing 120, a connection pipe 130 and a bracket 140.

The detergent supply device 110 includes an upper housing 112, a lower housing 113, a cover 111 to close the upper housing 112 and a detergent container 114 detachably coupled to the lower housing 113 at the front of the lower housing 113. The detergent container 114 has a detergent storage part 118. The detergent storage part 118 may be divided into several spaces by partitions.

The upper housing 112 may include a first upper housing 112*a* defining a water supply part 115 and a second upper housing 112*b* defining an inlet port 117 communicating with the water supply part 115. The first upper housing 112*a* and the second upper housing 112*b* may be separately manufactured and then coupled to each other. Alternatively, the first upper housing 112*a* and the second upper housing 112*b* may be integrally formed. A flow channel to allow the inlet port 117 to communicate with the water supply part 115 is defined in the second upper housing 112*b*.

The valve housing 120 is connected to the second upper housing 112*b* via the inlet port 117. A valve device (not shown) to control the supply of water is mounted in the valve housing 120. If the inlet port 117 formed at the second upper housing 112*b* is not located below the water supply part 115 of the first upper housing 112*a*, the valve device (not shown) may protrude upward from the first upper housing 112*a* with the result that assembly efficiency of the washing machine may be lowered. For this reason, the inlet port 117 is provided below the second upper housing 112*b* so that the inlet port 117 is located below the water supply part 115. As a result, the flow channel defined in the second upper housing 112*b* extends upward from the circumference of the inlet port 117 to the water supply part 115.

The water supply part 115 may include first, second, third and fourth water supply parts 115*a*, 115*b*, 115*c* and 115*d* divided by partitions. The inlet port 117 may include first, second, third and fourth inlet ports 117*a*, 117*b*, 117*c* and 117*d* communicating with the first, second, third and fourth water supply parts 115*a*, 115*b*, 115*c* and 115*d*, respectively.

The upper housing 112 is provided at the bottom thereof with a plurality of through holes 116 to allow water introduced into the water supply part 115 through the inlet port 117 to be supplied to the detergent container 114 therethrough.

The lower housing 113 has an outlet port 113*a*. The lower housing 113 is provided at opposite sides thereof with guide rails 113*b* to which the detergent container 114 is slidably coupled.

The detergent container 114 is open at the top thereof. The detergent storage part 118 may include a main washing detergent storage part 118*a*, a decolorant storage part 118*c*, a rinse storage part 118*d* and a preliminary washing detergent storage part 118*b* divided by partitions.

The main washing determining storage part 118*a* is open at the rear thereof so that supplied water flows to the outlet port 113*a* via the first water supply part 115*a* and the through holes 116. The decolorant storage part 118*c* and the rinse storage part 118*d* are provided at the bottoms thereof with siphon devices 118*e* and 118*f*, respectively, through which supplied water flows to the outlet port 113*a*. The bottoms of the main washing detergent storage part 118*a*, the preliminary washing detergent storage part 118*b*, the decolorant storage part 118*c* and the rinse storage part 118*d* are inclined rearward so that detergents are guided to the outlet port 113*a*.

Based on washing, rinsing or spin-drying, water, introduced into the detergent supply device 110, is selectively introduced into the detergent storage parts 118*a*, 118*b*, 118*c* and 118*d* through the first, second, third and fourth water supply parts 115*a*, 115*b*, 115*c* and 115*d* so that the water is mixed with detergent.

During preliminary washing, water, supplied through the second inlet port 117*b*, is introduced into the preliminary washing detergent storage part 118*b* through the through holes 116 of the second water supply part 115*b* so that the water is mixed with detergent.

During main washing, water, supplied through the first inlet port 117*a* and the third inlet port 117*c*, is introduced into the main washing detergent storage part 118*a* through the through holes 116 of the first water supply part 115*a* so that the water is mixed with detergent.

Rinsing may be performed twice. During first rinsing, water, introduced through the fourth inlet port 117*d*, is introduced into the decolorant storage part 118*c* through the third water supply part 115*c* so that the water is mixed with decolorant. During second rinsing, water, introduced through the first inlet port 117*a* and the fourth inlet port 117*d*, is introduced into the rinse storage part 118*d* through the fourth water supply part 115*d* so that the water is mixed with rinse.

The upper housing 112 has fixing protrusions 119*a* at which coupling holes are formed. The fixing protrusions 119*a* are screw coupled to the cabinet 10 shown in FIG. 1 so that the detergent supply device 110 is fixed to the cabinet 10.

Fixing protrusions 119*b* are provided below the inlet port 117. The valve housing 120 is screw coupled to the fixing protrusions 119*b* so that the valve housing 120 is fixed to the detergent supply device 110.

The valve housing 120 is coupled to the detergent supply device 110 to supply water to the detergent supply device 110. A valve device (not shown) to open or close a flow channel defined in the valve housing 120 is mounted in the valve housing 120. The valve device (not shown) controls the supply of water according to an electrical signal transmitted from a controller (not shown).

The valve housing 120 includes first and second introduction pipes 123 and 124, a discharge pipe 122 connected to the first and second introduction pipes 123 and 124, and a valve mounting part 121 disposed above flow channels defined by the first and second introduction pipes 123 and 124 and the discharge pipe 122. The valve mounting part 121 communicates with the flow channels. The valve device (not shown) is mounted at the valve mounting part 121 to open or close the flow channels. The valve device (not shown) may be fixed in a coupling port formed at the valve mounting part 121.

Different kinds of water may be introduced into the first introduction pipe 123 and the second introduction pipe 124. For example, cool water may be introduced into the first introduction pipe 123, and hot water may be introduced into the second introduction pipe 124.

The discharge pipe 122 may include first, second, third, fourth, fifth, and sixth discharge pipes 122*a*, 122*b*, 122*c*, 122*d*, 122*e* and 122*f*. The first, second, third, fourth, and sixth discharge pipes 122*a*, 122*b*, 122*c*, 122*d*, and 122*f* are connected to the first, second, third, fourth, and fifth inlet ports 117*a*, 117*b*, 117*c*, 117*d*, and 117*f* provided at the detergent supply device 110.

The fifth discharge pipe 122*e* is connected to a steam generator (not shown) provided to supply high-temperature steam into the rotary tub 30 shown in FIG. 2 to supply water to the steam generator. Water discharged through the fifth discharge pipe 122 is guided to the door glass 61 shown in FIG. 2 to clean the door glass 61.

A plurality of flow channels corresponding to the components constituting the discharge pipe 122 is defined in the valve housing 120. That is, the number of components constituting the valve mounting part 121 disposed above the flow channels corresponds to that of the components constituting the discharge pipe 122. Consequently, the valve mounting part 121 includes first, second, third, fourth, fifth and sixth valve mounting parts 121*a*, 121*b*, 121*c*, 121*d*, 121*e* and 121*f*.

The discharge pipe 122 is coupled to the inlet port 117 of the detergent supply device 110. The discharge pipe 122 may be fitted into the inlet port 117. A sealing member (not shown) may be provided to prevent water leakage from a coupling region between the discharge pipe 122 and the inlet port 117. The sealing member (not shown) may be an annular elastic member.

The valve housing 120 is provided at the lower part thereof with a fixing part 125 formed at a position corresponding to the fixing protrusions 119*b* of the detergent supply device 110. In a state in which the discharge pipe 122 is coupled to the inlet port 117, the fixing part 125 is screw coupled to the fixing protrusions 119*b* of the detergent supply device 110. The valve housing 120 is fixed to the detergent supply device 110 by screw coupling.

The first and second introduction pipes 123 and 124, the discharge pipe 122 and the valve mounting part 121 of the valve housing 120 may be integrally formed. Alternatively, a plurality of components may be coupled to constitute the valve housing 120. The valve housing 120 may be formed by injection molding.

The valve housing 120 may be made of polypropylene (PP). Polypropylene is easily injection molded and not easily broken at temperatures below zero Celsius.

The connection pipe 130 is connected to the valve housing 120 to guide water to the valve housing 120. The connection pipe 130 includes a first connection pipe 131 and a second connection pipe 132 connected to the first introduction pipe 123 and the second introduction pipe 124 of the valve housing 120, respectively, and a fixing member 133 provided between the first connection pipe 131 and the second connection pipe 132 to fix the first connection pipe 131 and the second connection pipe 132. The first connection pipe 131 and the second connection pipe 132 extend in the same direction in a state in which the first connection pipe 131 and the second connection pipe 132 are spaced a predetermined distance from each other.

The fixing member 133 is fixed to the first connection pipe 131 and the second connection pipe 132 between the first connection pipe 131 and the second connection pipe 132. A plurality of fixing members 133 may be provided.

Discharge ends of the first connection pipe 131 and the second connection pipe 132 may be coupled to the first introduction pipe 123 and the second introduction pipe 124 of the valve housing 120, respectively. The end of the first connection pipe 131 may be fitted in the end of the first introduction pipe 123. Alternatively, the end of the first introduction pipe 123 may be fitted in the end of the first connection pipe 131. The coupling between the second connection pipe 132 and the second introduction pipe 124 is achieved in the same manner as above. Sealing members (not shown) may be provided to prevent water leakage from coupling regions therebetween.

The first and second pipes 131 and 132 and the fixing member 133 of the connection pipe 130 may be integrally formed by injection molding. Alternatively, the first and second pipes 131 and 132 may be separately manufactured and then coupled to each other via the fixing member 133. The connection pipe 130 may be made of the same material as the valve housing 120, i.e. polypropylene-based synthetic resin.

In the above structure, the connection pipe 130 and the valve housing 120 are separate members. Alternatively, the connection pipe 130 is integrally formed at the valve housing 120 to constitute a portion of the valve housing 120. That is, the connection pipe 130, extending to an external water supply hose (not shown), may be integrally formed at the valve housing 120.

In the related art, a screw thread is formed at the introduction end of the connection pipe 130 so that an external water supply hose (not shown) is directly coupled to the connection pipe 130. In this case, the screw thread formed at the connection pipe 130 may be worn due to screw coupling to the water supply hose (not shown). In particular, if a coupling part (not shown), such as a nut, provided at the water supply hose (not shown) is made of metal, the screw thread may be more easily worn. If the screw thread is worn, the coupling force between the connection pipe 130 and the water supply hose (not shown) decreases with the result that water may leak from a coupling region therebetween.

Polypropylene, of which the connection pipe 130 is made, exhibits low wear resistance. For this reason, the screw thread formed at the connection pipe 130 may be easily worn upon screw coupling to the nut, which is made of metal.

Consequently, the water supply unit assembly 100 is coupled to the water supply hose (not shown), and a bracket 140 is provided to reduce wear of the screw thread at a coupling region therebetween.

Coupling protrusions 134, each having a coupling groove for coupling to the bracket 140, are provided at the introduction ends of the first connection pipe 131 and the second connection pipe 132. The bracket 140 is fixed to the connection pipe 130 by screw coupling to the coupling protrusions 134.

The bracket 140 is coupled to the external water supply hose (not shown) and the connection pipe 130 so that the external water supply hose and the connection pipe 130 communicate with each other. To this end, the bracket 140 includes first and second coupling pipes 142 and 143. The bracket 140 may include a support plate 141 formed around the first and second coupling pipes 142 and 143 and a socket coupling part 145 protruding from the support plate 141 to the introduction sides of the first and second coupling pipes 142 and 143.

Screw threads are formed at the introduction sides of the first and second coupling pipes 142 and 143. The external water supply hose (not shown) is screw coupled to the first and second coupling pipes 142 and 143.

The first and second coupling pipes 142 and 143 are made of a material exhibiting high wear resistance to reduce wear of the screw thread formed at the first and second coupling pipes 142 and 143. Since polypropylene, of which the valve housing 120 is made, exhibits low wear resistance, the screw thread formed at the valve housing 120 may be easily worn upon screw coupling to the nut, which is made of metal. For this reason, the first and second coupling pipes 142 and 143 are made of a different material than the valve housing 120.

The first and second coupling pipes 142 and 143 may be made of a material exhibiting higher wear resistance than polypropylene. For example, the bracket 140 may be made of polyamide-based nylon resin. Polyamide exhibits high wear resistance against metal. In particular, polyamide-based nylon resin, such as PA6 and PA66, may be used to form the first and second coupling pipes 142 and 143.

The first and second coupling pipes 142 and 143 and the support plate 141 of the bracket 140 may be integrally formed. In this case, injection molding may be used. Alternatively, a plurality of components may be separately manufactured and coupled to constitute the bracket 140.

Discharge ends of the first and second coupling pipes 142 and 143 are coupled to the first connection pipe 131 and the second connection pipe 132 of the connection pipe 130. The end of the first coupling pipe 142 may be fitted in the end of the first connection pipe 131. Alternatively, the end of the first connection pipe 131 may be fitted in the end of the first coupling pipe 142. Coupling between the second coupling pipe 143 and the second connection pipe 132 is achieved in the same manner as above. Sealing members 135 may be provided to prevent water leakage from coupling regions therebetween.

Coupling protrusions 144, corresponding to the coupling protrusions 134 of the first and second connection pipes 131 and 132, are provided at the discharge ends of the first and second coupling pipes 142 and 143. The bracket 140 is fixed to the connection plate 130 by screw coupling between the coupling protrusions 144 and the coupling protrusions 134 of the first and second connection pipes 131 and 132.

In the above structure, the connection pipe 130 and the bracket 140 are separate members. Alternatively, the connection pipe 130 may be integrally formed at the bracket 140 to constitute a portion of the bracket 140. That is, the connection pipe 130, extending from the discharge sides of the first and second coupling pipes 142 and 143 and connected to the valve housing 120, may be integrally formed at the bracket 140.

Figure 4:
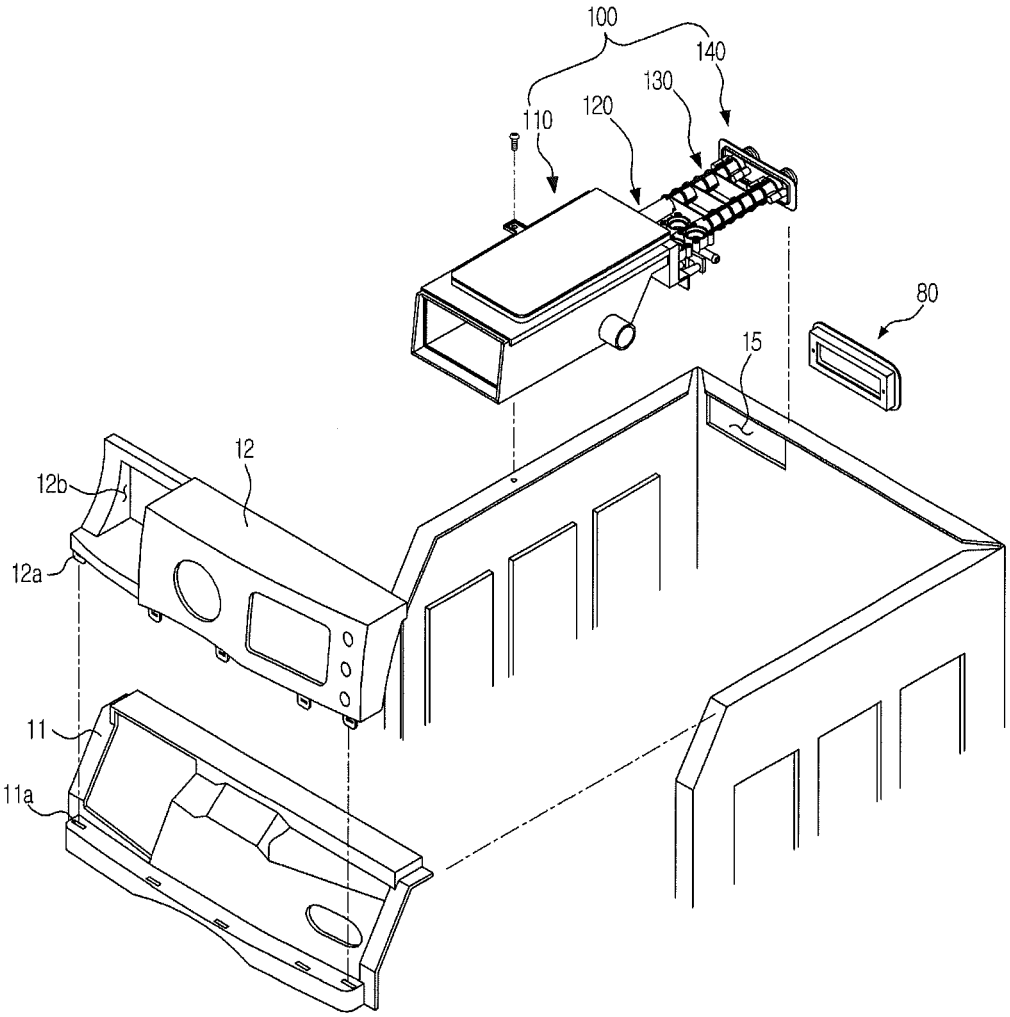
FIG. 4 is a view showing a state of the washing machine according to the embodiment of the present disclosure before the water supply unit assembly is mounted in a cabinet.
Figure 5A:
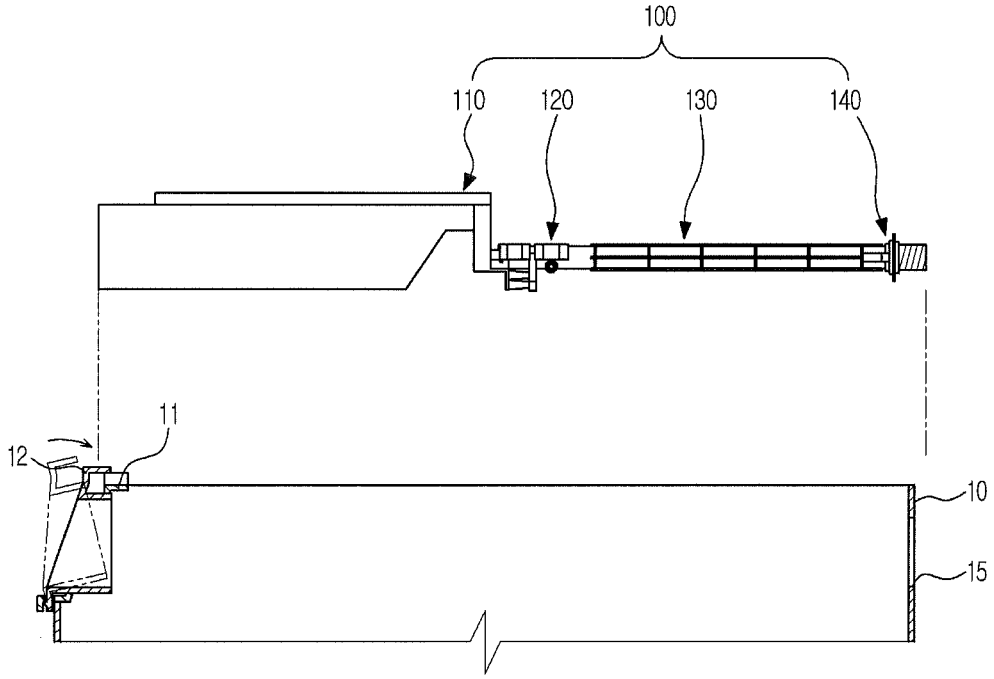
FIGS. 5A to 5C are views showing a process of mounting the water supply unit assembly in the cabinet of the washing machine according to the embodiment of the present disclosure.
Figure 5B:
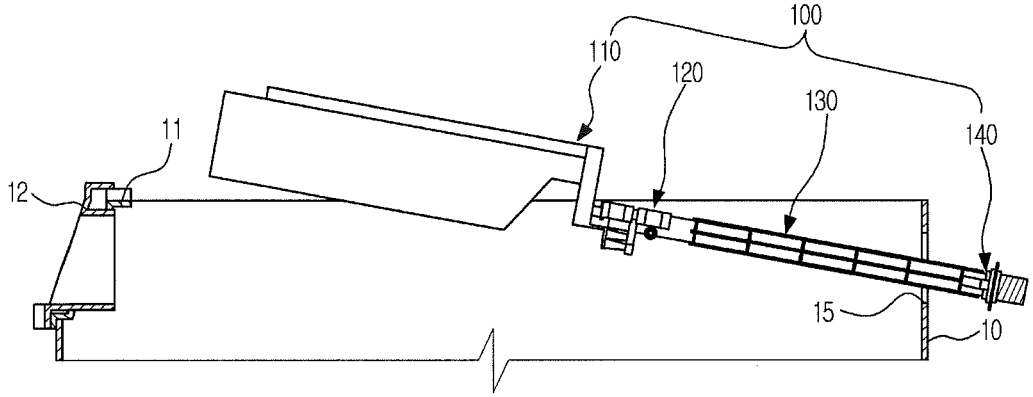
Figure 5C:
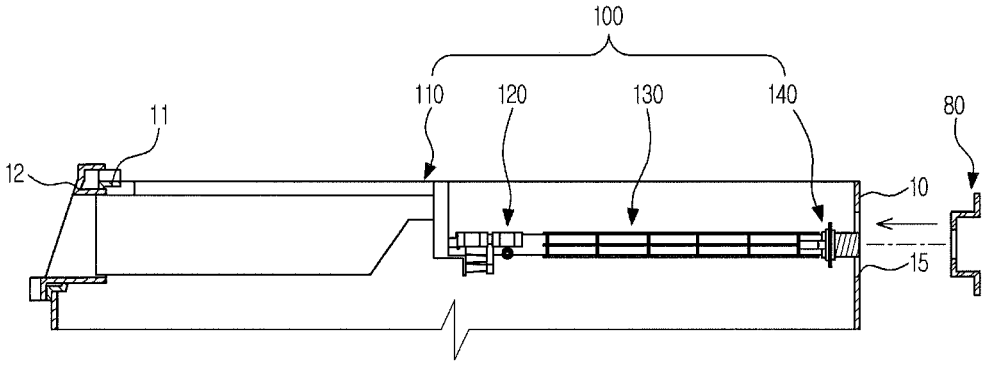
Figure 6:
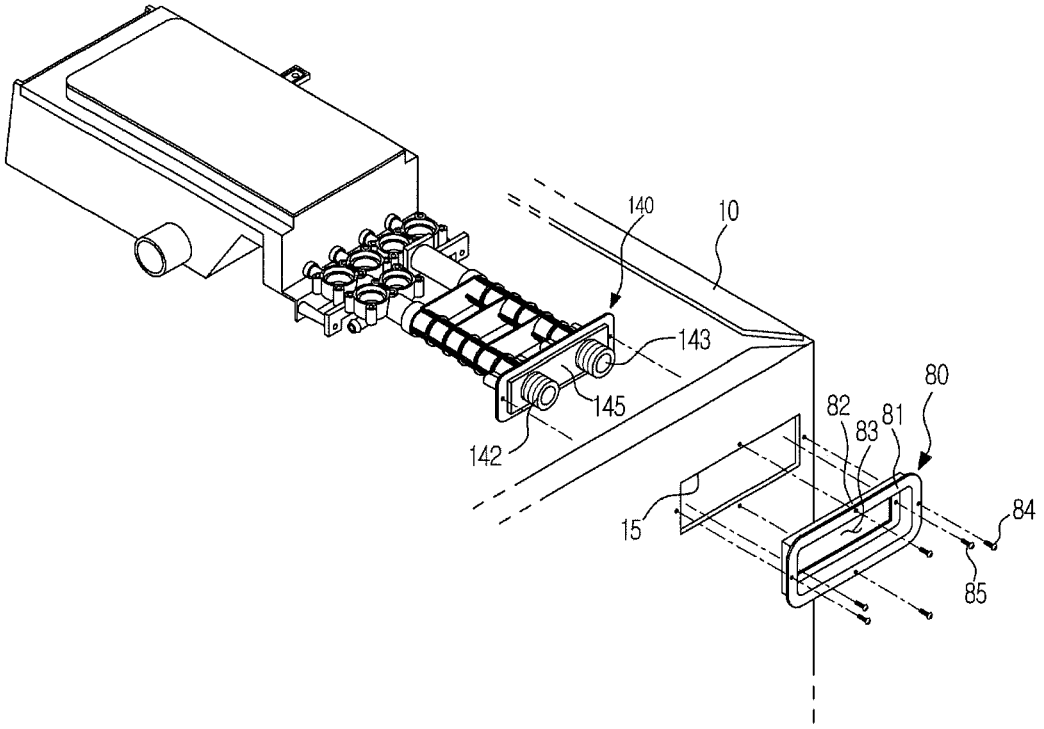
FIG. 6 is a view showing the water supply unit assembly fixed to the rear of the cabinet of the washing machine according to the embodiment of the present disclosure.

FIG. 4 is a view showing a state of the washing machine according to the embodiment of the present disclosure before the water supply unit assembly is mounted in the cabinet, FIGS. 5A to 5C are views showing a process of mounting the water supply unit assembly in the cabinet of the washing machine according to the embodiment of the present disclosure, and FIG. 6 is a view showing the water supply unit assembly fixed to the rear of the cabinet of the washing machine according to the embodiment of the present disclosure.

Generally, the front plate 11 is mounted in the cabinet 10, and the detergent supply device and the valve device are mounted in the cabinet 10 to assemble the washing machine. As shown in FIGS. 4 and 5A, it is difficult to mount the water supply unit assembly 100 in the cabinet 10 in a state in which the front plate 11 is mounted to the cabinet 10 since the length of the water supply unit assembly 100 corresponds to the length of the cabinet 10 in the frontward-to-rearward direction. In the washing machine in which the detergent supply device and the valve housing are coupled to each other, and the water supply unit assembly 100, which is rigid, is directly connected to an external water supply source, therefore, the water supply unit assembly 100 is mounted in the cabinet 10 and then the front plate 11 is mounted in the cabinet 10 in reverse order. However, reverse assembly order changes a production process, increasing production cost. For this reason, it may be necessary to maintain the assembly order even using the water supply unit assembly 100.

First, the front plate 11 is mounted to the cabinet 10. The front plate 11 may be fixed to the cabinet 10 by one or more screws. Subsequently, the control panel mounting unit 12 is mounted to the front plate 11. The control panel mounting unit 12 has a coupling protrusion 12*a*, and the front plate 11 has a coupling groove 11*a* corresponding to the coupling protrusion 12*a*. In a state in which the coupling protrusion 12*a* of the control panel mounting unit 12 is fitted in the coupling groove 11*a* of the front plate 11, the control panel mounting unit 12 is rotated about the coupling protrusion 12*a* so that the control panel mounting unit 12 comes into tight contact with the front plate 11. The control panel mounting unit 12 is fixed to the front plate 11 using a fixing member, such as a screw.

The control panel mounting unit 12 has a mounting port 12*b* in which the detergent supply device 110 is mounted. The mounting port 12*b* is formed in a shape corresponding to the edge of the front opening of the detergent supply device 110. Consequently, the front of the detergent supply device 110 is coupled to the mounting port 12*b*.

The assembly port 15, through which the bracket 140 passes, is provided at the rear of the cabinet 10 so that detergent supply device 110 is coupled to the mounting port 12*b* in a state in which the front plate 11 and the control panel mounting unit 12 are mounted to the cabinet 11. Also, the fixing socket 80 to fix the bracket 140 to the cabinet 10 is provided at the rear of the cabinet 10.

As shown in FIG. 5B, the water supply unit assembly 100 is inclined so that the bracket 140 is located at a lower position. When the water supply unit assembly 100 is inserted into the cabinet 10 so that the bracket 140 passes through the assembly port 15, a space, in which the detergent supply device 110 will be inserted into the cabinet 10, is formed at the upper front of the cabinet 10.

The detergent supply device 110 is rotated downward and put in the cabinet 10. Subsequently, the water supply unit assembly 100 is moved to the front of the cabinet 10 and coupled to the control panel mounting unit 12 so that the water supply unit assembly 100 is mounted in the cabinet 10.

As shown in FIG. 5C, the detergent supply device 110 is fixed to the cabinet 10 so that the water supply unit assembly 100 is fixed to the cabinet 10. The fixing protrusions 119*b* of detergent supply device 110 are screw coupled to the cabinet 10 so that the detergent supply device 110 is fixed to the cabinet 10. Subsequently, the fixing socket 80 is coupled to the assembly port 15 at the rear of the cabinet 10.

As shown in FIG. 6, the fixing socket 80 is coupled to the cabinet 10 and the bracket 140 so that the bracket 140 is fixed to the cabinet 10.

The fixing socket 80 includes a socket body 82 having a coupling port 83 and a flange 81 formed by bending one end of the socket body 82. The socket body 82 is formed in a shape corresponding to the assembly port 15 so that the socket body 82 is coupled to the assembly port 15. The coupling port 83 is formed in a shape corresponding to the socket coupling part 145 of the bracket 140 so that the coupling port 83 is coupled to the socket coupling part 145. The first and second coupling pipes 142 and 143 pass through the coupling port 83 to protrude out of the cabinet 10 so that the first and second coupling pipes 142 and 143 are coupled to the external water supply hose (not shown).

The fixing socket 80 is coupled to the assembly port 15 and the bracket 140. The fixing socket 80 is fixed to the cabinet 10 by a first screw 84. The bracket 140 is fixed to the fixing socket 80 by a second screw 85. A plurality of first screws 84 and a plurality of second screws 85 may be provided.

As is apparent from the above description, the washing machine with the above-stated construction does not use a flexible hose, thereby reducing the number of assembly processes and cost of parts. In addition, an integral water supply unit assembly uses a separate bracket, thereby improving wear resistance at a coupling region between the integral water supply unit assembly and an external water supply hose. Consequently, product damage and water leakage due to wear at the coupling region are prevented.

Also, an assembly port is formed at the rear of a cabinet. Consequently, a front plate is first assembled and then the water supply unit assembly is assembled, thereby employing the same assembly process as when using the existing flexible water supply hose.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A washing machine comprising:

a cabinet;

a washing tub disposed in the cabinet;

a detergent container housing including a lower housing to accommodate a detergent container and an upper housing;

a valve housing connected to the upper housing of the detergent container housing, the valve housing including a plurality valve devices to control water supply;

a coupling pipe protruding outside of the cabinet, the coupling pipe being configured to be coupled to an external water supply hose to supply water into the cabinet, the external water supply hose to be coupled to the coupling pipe outside of the cabinet;

a support plate disposed entirely inside the cabinet and formed around the coupling pipe; and a rigid connection pipe to connect the valve housing to the coupling pipe, wherein the upper housing of the detergent container housing comprises a plurality of inlet ports, the valve housing comprises a plurality of introduction pipes and a plurality of discharge pipes, the number of the plurality of discharge pipes of the valve housing is more than the number of the plurality of inlet ports of the detergent container housing, at least some of the plurality of discharge pipes are connected to the plurality of inlet ports, and the rigid connection pipe comprises a first connecting pipe and a second connecting pipe which are integrally formed such that the first connecting pipe is connected to a first introduction pipe among the plurality of introduction pipes and the second connecting pipe is connected to a second introduction pipe among the plurality of introduction pipes.

2. The washing machine according to claim 1, wherein the valve housing and the coupling pipe are made of different materials.

3. The washing machine according to claim 2, wherein the coupling pipe is made of a material exhibiting higher wear resistance than the valve housing.

4. The washing machine according to claim 3, wherein the coupling pipe is made of polyamide (PA).

5. The washing machine according to claim 1, wherein the valve housing further comprises:

a plurality of valve mounting parts corresponding to the plurality of the discharge pipes.

6. The washing machine according to claim 5, further comprising:

a steam generator to supply steam to the washing tub, wherein one of the plurality of discharge pipes is coupled to the steam generator.

7. The washing machine according to claim 5, wherein the valve housing is fixed to the detergent container housing by a screw.

8. The washing machine according to claim 1, wherein the coupling pipe and the support plate are integrally formed.

9. The washing machine according to claim 1, further comprising a fixing socket mounted on the outside of the cabinet, wherein a portion of the fixing socket protrudes to an inside of the cabinet and is coupled to the support plate.

10. The washing machine according to claim 9, wherein the support plate is spaced apart from a rear wall of the cabinet when the support plate is coupled to the fixing socket.

11. The washing machine according to claim 1, wherein the rigid connection pipe and the coupling pipe are made of different materials.

12. The washing machine according to claim 11, wherein the rigid connection pipe is made of polypropylene and the coupling pipe is made of polyamide (PA).

13. The washing machine according to claim 12, wherein the valve housing is made of polypropylene.

14. The washing machine according to claim 1, wherein the coupling pipe comprises a first coupling pipe fitted in the first connecting pipe and a second coupling pipe fitted in the second connecting pipe.

15. The washing machine according to claim 1, wherein the rigid connection pipe further comprises a coupling protrusion to fix the rigid connection pipe to the support plate.

16. The washing machine according to claim 1, wherein the detergent container housing further includes a cover to close the upper housing, the upper housing includes a first upper housing including a water supply part and a second upper housing including the plurality of inlet ports which communicate with the water supply part.

* * * * *